US008827285B1

(12) United States Patent
Su

(10) Patent No.: US 8,827,285 B1
(45) Date of Patent: Sep. 9, 2014

(54) WHEEL AXLE FIXING STRUCTURE OF SKATEBOARD

(71) Applicant: Yuche Su, Taipei (TW)

(72) Inventor: Yuche Su, Taipei (TW)

( * ) Notice: Subject to any disclaimer, the term of this patent is extended or adjusted under 35 U.S.C. 154(b) by 0 days.

(21) Appl. No.: 13/944,892

(22) Filed: Jul. 18, 2013

(51) Int. Cl.
*A63C 17/01* (2006.01)

(52) U.S. Cl.
CPC ..... *A63C 17/017* (2013.01); *A63C 17/01* (2013.01); *A63C 17/012* (2013.01)
USPC ..... 280/87.042; 280/11.27; 411/107; 301/132

(58) Field of Classification Search
CPC .... B60B 35/004; B60B 35/02; B60B 35/025; B60B 35/04; B60B 2310/305; B60B 2900/311; A63C 17/00; A63C 17/01; A63C 17/012; A63C 17/017; A63C 17/226
USPC ..... 280/87.042, 11.27, 124.125; 301/5.305, 301/124.1, 131, 132; 411/107, 109
See application file for complete search history.

(56) References Cited

U.S. PATENT DOCUMENTS

| | | | | |
|---|---|---|---|---|
| 4,109,925 | A * | 8/1978 | Williams et al. | 280/11.28 |
| 6,884,014 | B2 * | 4/2005 | Stone et al. | 411/352 |
| 2006/0131826 | A1 * | 6/2006 | Schonblom et al. | 280/87.042 |
| 2009/0140570 | A1 * | 6/2009 | Houkal | 301/1 |
| 2013/0113170 | A1 * | 5/2013 | Braden et al. | 280/11.27 |
| 2014/0027989 | A1 * | 1/2014 | Baumann | 280/11.27 |

* cited by examiner

*Primary Examiner* — J. Allen Shriver, II
*Assistant Examiner* — Steve Clemmons
(74) *Attorney, Agent, or Firm* — Leong C. Lei

(57) ABSTRACT

A wheel axle fixing structure of a skateboard is provided for overcoming the drawbacks of a conventional coupling structure between a mounting bracket and a wheel axle of a skateboard and includes a mounting bracket, a wheel axle, and a fixing collar. The mounting bracket has an axle receiving hole that includes two internal threading sections having threads of opposite directions (such as forward thread and backward thread). The wheel axle has an axle external threading section and is fit to the fixing collar that has a collar external threading section. The axle external threading section and a collar external threading section are respectively screwed to the two internal threading sections having threads of opposite directions. The opposite directions of the threads at the two threaded sections provides tightening effects in opposite direction so that one threaded section getting loosened help more securely tighten the other threaded section.

5 Claims, 4 Drawing Sheets

WHEEL AXLE FIXING STRUCTURE OF SKATEBOARD

TECHNICAL FIELD OF THE INVENTION

The present invention generally relates to a technical field of skateboard, and more particularly to a wheel axle fixing structure of a skateboard that secures a skateboard wheel axle to a skateboard mounting bracket through screwing operations without axial displacement of the axle and provides the advantages of improved stability, increased speed, enhanced safety of use and improved precision, reduced manufacture cost, being free of detachment of the wheel axle of the skateboard, and beautified outside appearance.

DESCRIPTION OF THE PRIOR ART

A skateboard is a carrying structure that allows a user to stand thereon and propel with the feet of the user so as to achieve a function of exercise. Further, the skateboard provides a function of sliding motion by the user inclining and swaying his or her body or even by run-up of the user, so that sliding motion may be used as a tool of transportation or a tool for leisure or amusement. Further, complicated and difficult postures of for example sky rotation are also developed for performance or competition. Thus, skateboard is now a prevailing and popular sport in. European and American areas for people of all ages. With the popularization of skateboard sport in the foreign countries, making it spread all over the world, the domestic population of skateboard sport is getting increased.

Conventionally, the most commonly seen structure of skateboard, in both domestic area and foreign countries, comprise a mounting bracket attached to each of front and rear ends of an underside of a skateboard. The mounting bracket comprises a threaded rod (namely a skateboard wheel axle) to which skate wheels are mounted in a left-right symmetric manner. Such a known structure of skateboard allows a user to stand thereon and to propel with the feet of the user to achieve a function of exercise, but the mounting bracket and the threaded rod show numerous drawbacks and shortcomings.

The shortcomings of the mounting bracket will be discussed first. One of the most commonly seen skateboard structures comprises a mounting bracket through which a threaded rod extends and skateboard wheels are coupled to two ends of the threaded rod. However, since the threaded rod is of a great length, so that it may be of insufficient straightness and may get swaying, leading to accelerated wearing of the skateboard wheel and reducing the sliding speed of the skateboard.

Next, the shortcoming of the threaded rod will be discussed.

(1) In the most commonly seen structures of skateboard, the mounting bracket is first heated to cause it to expand and a threaded rod is fir into each of two ends of the mounting bracket, whereby by application of the principle of thermal expansion and cool retraction, after cooling, the threaded rods are fixed. Such a process of assembling often leads to an increased cost.

(2) Following the description given in item (1), if the two ends of the mounting bracket are coupled to the threaded rods through application of adhesives, due to the poor bonding force of the adhesive, the threaded rods may easily detach and fall so as to affect the security and safety of skateboard.

(3) In one of the commonly seen structures of skateboard, the mounting bracket and the threaded rod are assembled by inserting a pin; however, such an arrangement may affect the aesthetics of the outside appearance and may lead to easy detachment and falling, eventually causing concern of security and safety of the skateboard.

Thus, the known coupling structure of the mounting bracket and threaded rods (namely the wheel axles of the skateboard) is not perfect and further improvement is desired.

The present invention aims to provide a solution that overcomes such problems.

SUMMARY OF THE INVENTION

An object of the present invention is to provide a wheel axle fixing structure of a skateboard that allows a wheel axle and a mounting bracket of a skateboard to be coupled to each other with two threaded joint sections that comprise threads of opposite directions (such as forward thread and backward thread), whereby one of the threaded joint sections getting loosened may more tightly screw the other threaded joint section (namely being tightly screwed due to reaction) so that the wheel axle can be securely screwed and fixed to an axle receiving hole without axial displacement.

To achieve the above object, the present invention comprises a mounting bracket, a wheel axle, and a fixing collar, wherein the mounting bracket is mounted to an underside of the skateboard and comprises at least one axle receiving hole, which comprises a first internal threading section and a second internal threading section. The first and second threading sections have threads that are opposite in direction to each other. The wheel axle has an end comprising an axle external threading section and a stop rim is formed at one end of the axle external threading section. An opposite end of the wheel axle receives a skateboard wheel to couple thereto. The fixing collar comprises a bore formed therethrough and a collar external threading section, which has a thread that is opposite in direction to a thread of the axle external threading section. The axle external threading section is screwed to the first internal threading section of the axle receiving hole and the fixing collar is fit over an external circumference of the wheel axle with the through bore thereof and is positioned against the stop rim. The collar external threading section is screwed to the second internal threading section to fix the wheel axle in the axle receiving hole without axial displaceability. As such, the advantages of providing the skateboard with improved stability, increased speed, enhanced safety of use and improved precision, reduced manufacture cost, being free of detachment of the wheel axle of the skateboard, and beautified outside appearance can be achieved.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
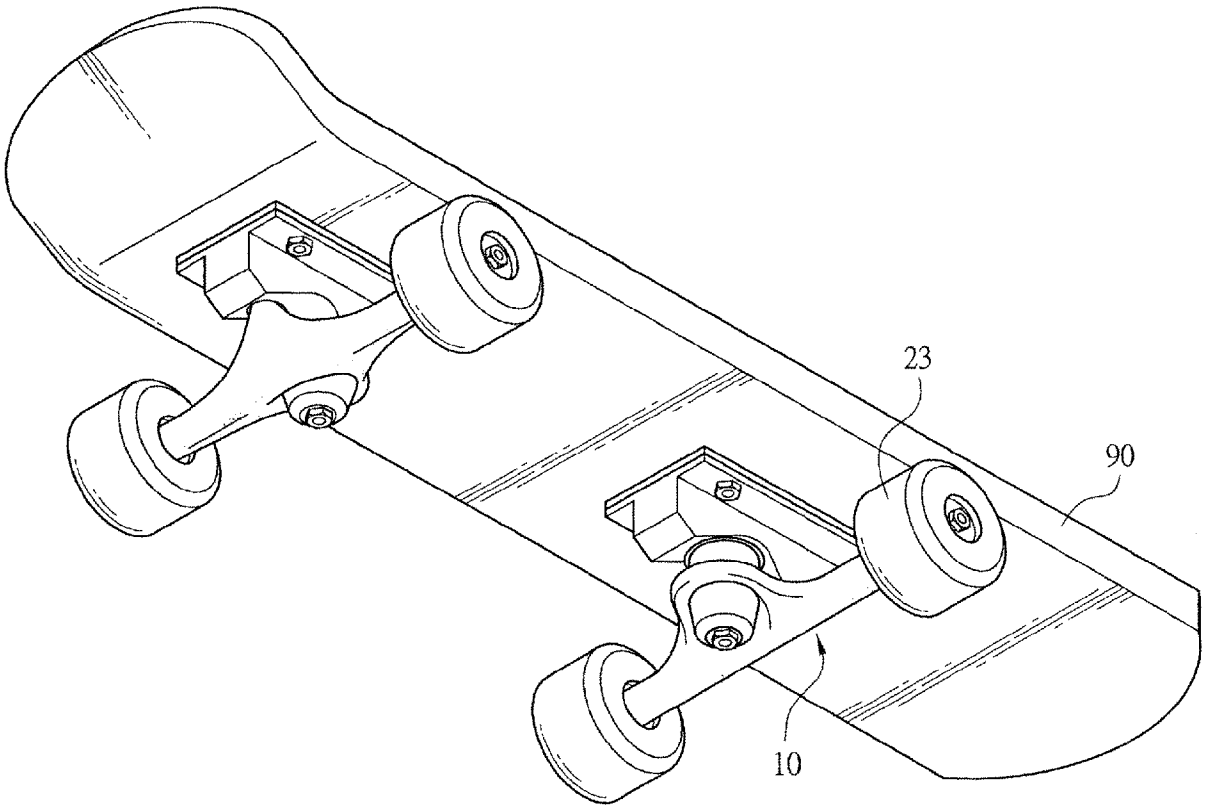
FIG. 1 is a perspective view of the present invention.
Figure 2:
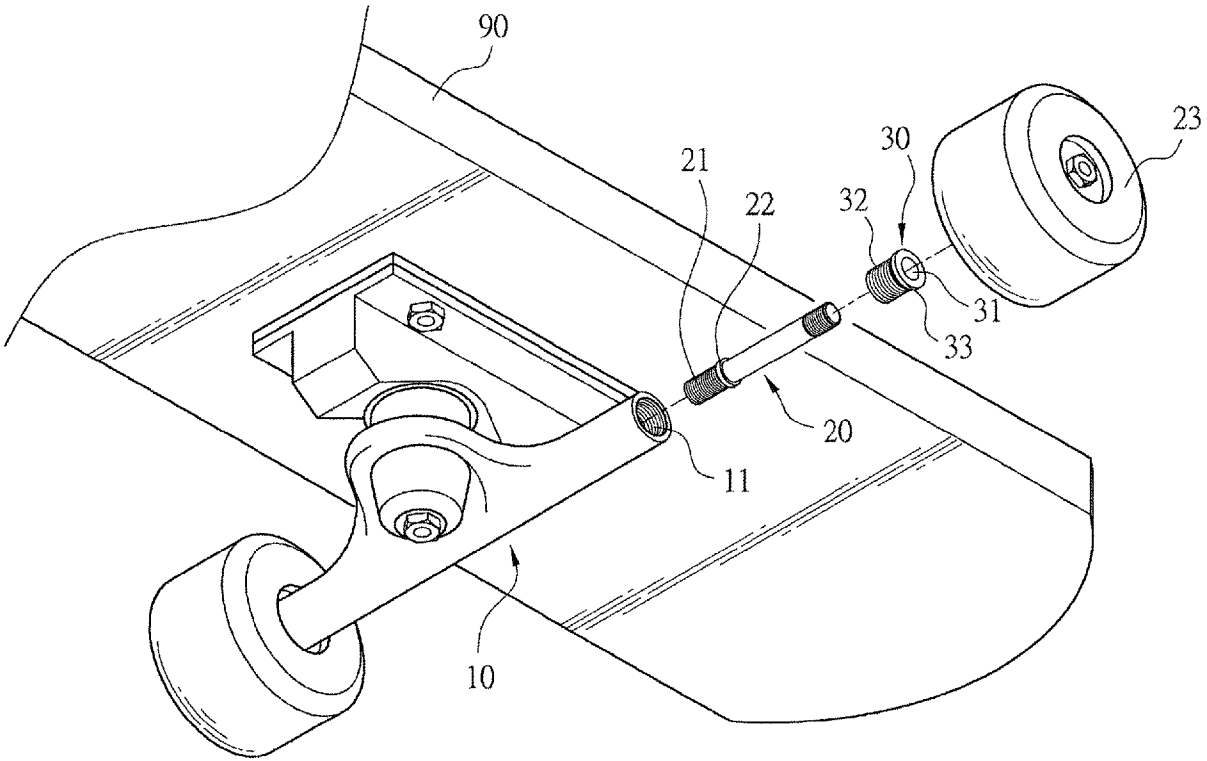
FIG. 2 is an exploded view of the present invention.
Figure 3:
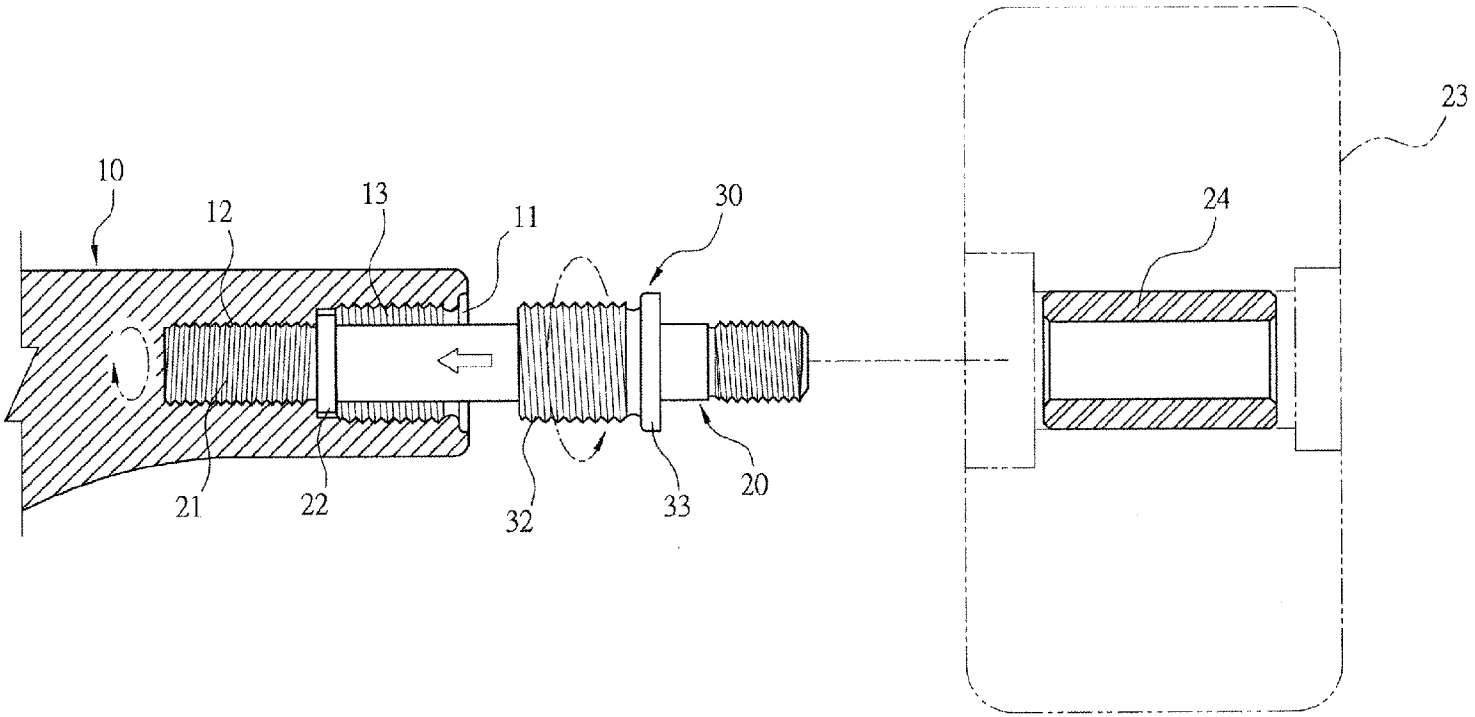
FIG. 3 is a cross-sectional view illustrating assembling of the present invention.

Referring to FIGS. 1, 2, and 3, a preferred embodiment of the present invention comprises a mounting bracket 10, a wheel axle 20, and a fixing collar 30. The fixing collar 30 is fit over the wheel axle 20. The mounting bracket 10 and the wheel axle 20 are coupled to each other with two threaded joint sections that have threads of opposite directions (forward and backward threads). In other words, when one of the threaded joint sections gets loosened, the other threaded joint section would be caused to induce an opposite tightening operation (namely being tightly screwed due to reaction), whereby the wheel axle can be securely fixed, through threading engagement, to an axle receiving hole without axial displacement. As such, the skateboard of the present invention may achieve the advantages of improved stability, increased speed, enhanced safety of use and improved precision, reduced manufacture cost, being free of detachment of the wheel axle of the skateboard, and beautified outside appearance.

Referring to FIGS. 2 and 3, the mounting bracket 10 according to the present invention has two sides in which two opposite axle receiving holes 11 are respectively formed. Each of the axle receiving holes 11 comprises a first internal threading section 12 and a second internal threading section 13. The first internal threading section 12 and the second internal threading section 13 have threads that are opposite to each other. The mounting bracket 10 is mounted to an underside of a skateboard 90.

In the instant embodiment, the first internal threading section 12 comprises a forward thread and the second internal threading section 13 comprises a backward thread.

Since the coupling structure between the skateboard 90 and the mounting bracket 10 is well known and constitute no novel part of the present invention, further details will not be given herein. Further, since the two wheel axles 20 coupled to the two sides of the mounting bracket 10 are provided with identical coupling structures, the following description will be only given to the coupling of a wheel axle 20 to one side of the mounting bracket 10, but it is equally applicable to the other side of the mounting bracket.

The wheel axle 20 has an end forming an axle external threading section 21. A stop rim 22 is provided at one end of the axle external threading section 21. An opposite end of the wheel axle 20 is coupled to a skateboard wheel 23.

The fixing collar 30 comprises a bore 31 and a collar external threading section 32. The collar external threading section 32 has a thread that is opposite to a thread of the axle external threading section 21.

In the instant embodiment, the axle external threading section 21 comprises a forward thread and the collar external threading section 32 comprises a backward thread.

The above descriptions are given to the structures of the components/parts of the present invention. The following description will be given to the operation, principle, and features of coupling.

Figure 4:
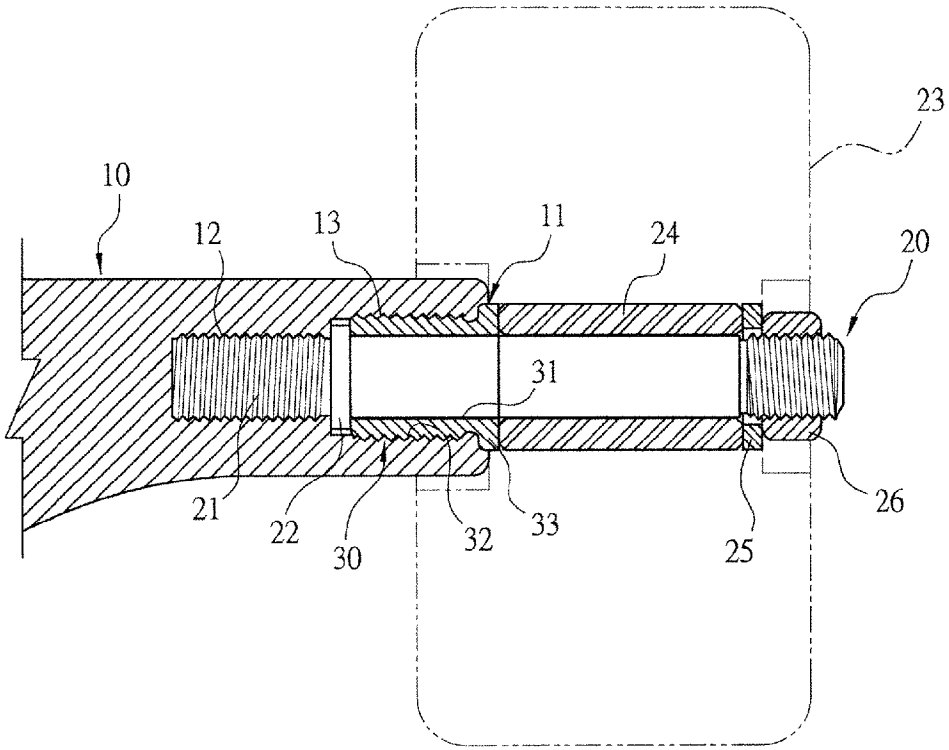
FIG. 4 is a cross-sectional view of the present invention in an assembled form.

Referring to FIGS. 3 and 4, the axle external threading section 21 is screwed to the first internal threading section 12 of the axle receiving hole 11. The fixing collar 30 is fit, with the bore 31 thereof, over the outer circumference of the wheel axle 20 and is moved until reaching the stop rim 22. An opposite end of the fixing collar receives the skateboard wheel 23 to position thereon for constraining the fixing collar at a predetermined location on the wheel axle 20. Further, the collar external threading section 32 is screwed to the second internal threading section 13.

As such, the wheel axle 20 may be provided with opposite direction tightening effect (namely being tightly screwed due to reaction) by the two threaded joint sections, where one threaded joint section that is the engagement between the axle external threading section 21 and the first internal threading section 12 and the other threaded joint section that is the engagement between the collar external threading section 32 and the second internal threading section 13 are of threads that are opposite in direction. In other words, one threaded joint section getting loosened would cause the other threaded joint section to be more tightly screwed. For example, the axle external threading section 21 that has a forward thread can be tightened through reaction caused by the collar external threading section 32 that has a backward thread. Consequently, one end of the wheel axle 20 is secured in the axle receiving hole 11 with no axial displacement allowed. In other words, the wheel axle 20 will never get detached. Further, the coupling structure between the mounting bracket 10 and the wheel axle 20 is completely concealed in the axle receiving hole 11 and is not exposed.

To summarize the above description, the present invention provides the advantages of providing a skateboard with improved stability, increased speed, enhanced safety of use and improved precision, reduced manufacture cost, being free of detachment of the wheel axle of the skateboard, and beautified outside appearance. The drawbacks of the coupling structure of the mounting bracket and the skateboard wheel axle of the conventional skateboard can be overcome.

Referring to FIGS. 3 and 4, the skateboard wheel 23 according to the present invention is mounted to the wheel axle 20 via a bearing 20. The wheel axle 20 is also fit to a washer 25 positioned against the bearing 24 and secured by a nut 26. As such, the skateboard wheel 23 is securely attached to the wheel axle 20.

The nut 26 can be a nylon Nylok nut. As such, the backward threading section, which is the collar external threading section 32, would not get loosened so that the safety of the present invention can be assured.

It is noted here that for a conventional skateboard, the skateboard wheel axle is fit to a washer and fitting to a washer is to prevent the bearing of the skateboard wheel axle from get worn or to help the bearing to smoothly rotate.

It is noted here that the fixing collar 30 according to the present invention is provided with a flange 33 at one end thereof, whereby when the fixing collar 30 is screwed to the axle receiving hole 11, the flange 33 is arranged to partly project out of the axle receiving hole 11 to contact and position against the bearing 24.

As such, the flange 33 may replace the washer that is fit to the conventional skateboard wheel axle. However, in the present invention, the fixing collar 30 and the "washer" are integrally formed together to provide, besides the effect of wearing protection and helping the bearing to rotate provided by the conventionally used washer, the advantages of eliminating the expense of washer in a manufacture process and also saving the time for fitting the washer in an assembling process (which also leads to reduction of cost).

Referring to FIGS. 3 and 4, before the present invention is assembled, the axle external threading section 21 and the collar external threading section 31 are processed by applying adhesive thereto in advance.

As such, the two threaded joint sections of the wheel axle 20, namely the threaded joint section between the axle external threading section 21 and the first internal threading section 12 and the threaded joint section between the collar external threading section 13 and the second internal threading section 13, are provided enhanced bonding and fixing force through the application of the adhesive.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A skateboard wheel axle fixing structure, comprising:

a mounting bracket, which is adapted to be mounted to an underside of the skateboard and comprises at least one axle receiving hole, which comprises a first internal threading section and a second internal threading section, the first and second threading sections having threads that are opposite in direction to each other;

a wheel axle, which has an end comprising an axle external threading section, a stop rim being formed at one end of the axle external threading section, an opposite end of the wheel axle being adapted to receive a skateboard wheel to couple thereto; and a fixing collar, which comprises a bore formed therethrough and a collar external threading section, which has a thread that is opposite in direction to a thread of the axle external threading section;

wherein the axle external threading section is screwed to the first internal threading section of the axle receiving hole and the fixing collar is fit over an external circumference of the wheel axle with the through bore thereof and positioned against the stop rim, the collar external threading section being screwed to the second internal threading section to fix the wheel axle in the axle receiving hole without axial displaceability.

2. The skateboard wheel axle fixing structure according to claim 1, wherein the fixing collar has an end on which a flange is formed, the flange being arranged to partly project out of the axle receiving hole and contact and position against a bearing mounted to the skateboard wheel.

3. The skateboard wheel axle fixing structure according to claim 1, wherein the axle external threading section and the collar external threading section receive adhesive applied thereto.

4. The skateboard wheel axle fixing structure according to claim 1, wherein the first internal threading section comprises a forward thread and the second internal threading section comprises a backward thread.

5. The skateboard wheel axle fixing structure according to claim 1, wherein the axle external threading section comprises a forward thread and the collar external threading section comprises a backward thread.

* * * * *